United States Patent [19]

Chavany et al.

[11] 4,422,601

[45] Dec. 27, 1983

[54] SYSTEM FOR GUIDING A MISSILE BY MODULATED LIGHT BEAM

[75] Inventors: Jean C. Chavany, Chatenay-Malabry; Wladimir Koreicho, Chilly-Mazarin, both of France

[73] Assignee: Societe Anonyme de Telecommunications, Paris, France

[21] Appl. No.: 227,603

[22] Filed: Jan. 23, 1981

[30] Foreign Application Priority Data

Jan. 29, 1980 [FR] France ..... 80 01841

[51] Int. Cl.[3] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 3,690,594 | 9/1972 | Menke | 244/3.13 |
| 4,014,482 | 3/1977 | Esker et al. | 244/3.13 |
| 4,149,686 | 4/1979 | Stauff et al. | 244/3.13 |
| 4,243,187 | 1/1981 | Esker | 244/3.13 |

*Primary Examiner*—Charles T. Jordan

*Attorney, Agent, or Firm*—Holman & Stern

[57] ABSTRACT

System for guiding a missile in a direction of sight, comprising, at emission, a source of emission producing a light beam of which the axis defines the direction of sight and a device for modulating the beam emitted, and, on the missile, at least one photodetector and a processing circuit for determining, from the output signal from the detector, at least one coordinate of the missile with respect to the direction of sight, said coordinate being applied to the control surfaces of the missile in order to control the path of the missile on the directin of sight. The modulation device comprises a sight in the form of a band comprising repetitive motifs, a movement of translation at constant speed being created between the beam and the sight, in a direction perpendicular to the axis of the beam, each motif comprising opaque and transparent parts, the opaque and/or transparent parts having a length (measured in the direction of displacement) which varies according to the height in question. A time base is provided for determining the two coordinates of the missile.

7 Claims, 11 Drawing Figures

FIG. 1
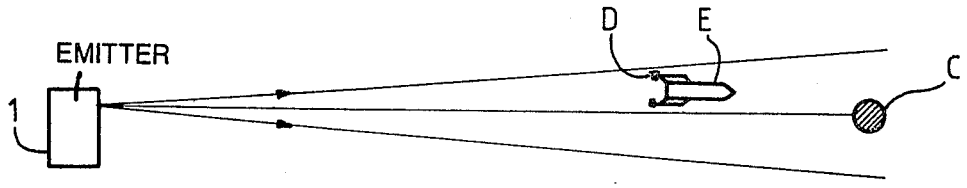
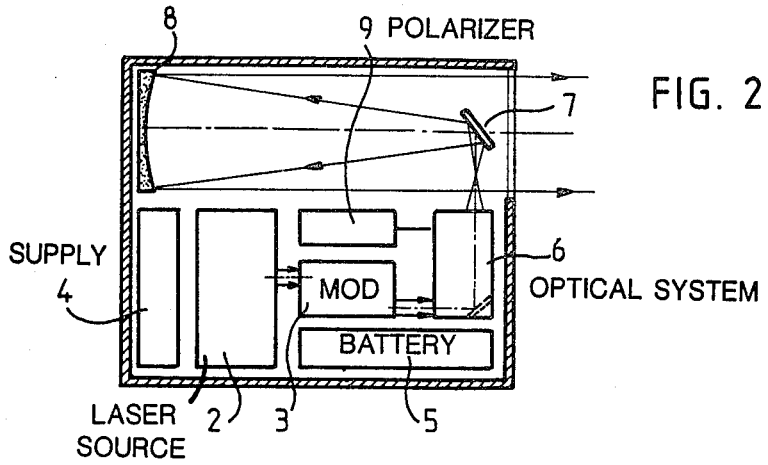
FIG. 2
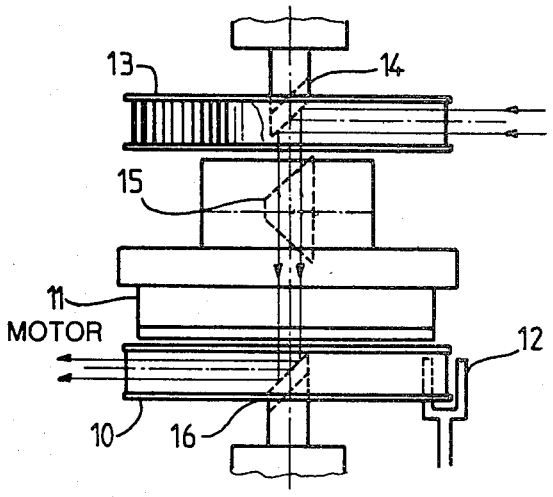
FIG. 3

Fig. 4a
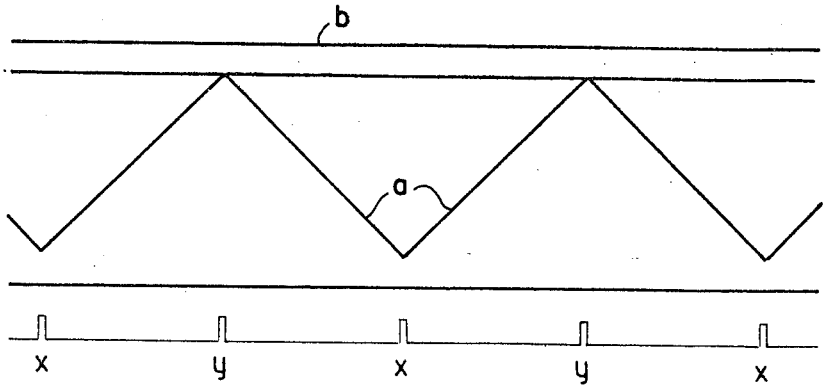
Fig. 4b
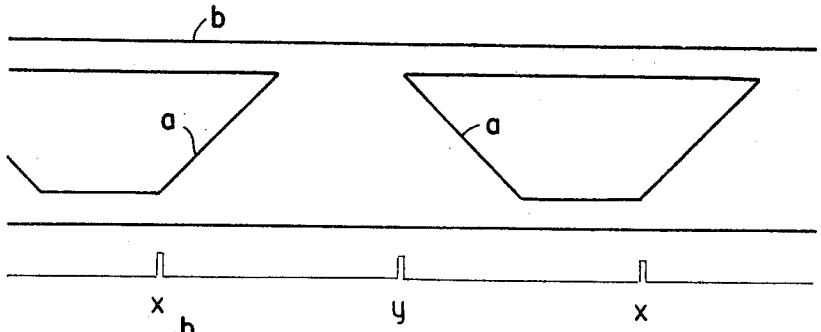
Fig 4c
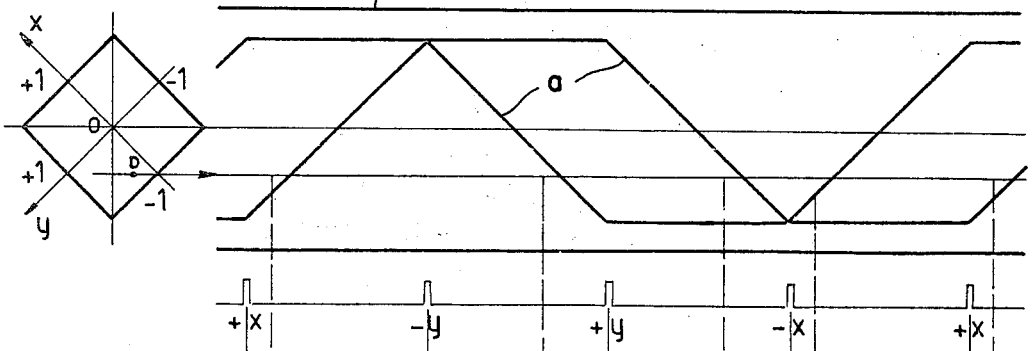
Fig. 5
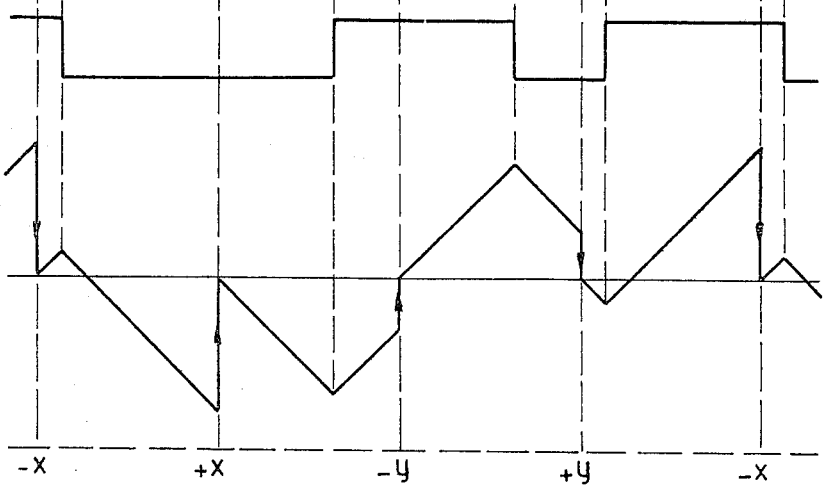
Fig. 6

SYSTEM FOR GUIDING A MISSILE BY MODULATED LIGHT BEAM

BACKGROUND OF THE INVENTION

The present invention relates to a system for guiding a missile in a direction of sight, comprising, at emission, a source of emission producing a light beam of which the axis defines the direction of sight and a device for modulating the emitted beam and, on the missile, at least one photo-detector and a processing circuit for determining, from the output signal from the detector, at least one coordinate of the missile with respect to the direction of sight, said coordinate being applied to the control surfaces of the missile to control the path of the missile on the direction of sight.

In known systems of this type, a rotating sight of relatively complicated form is generally used for modulating the beam, and the modulated beam thus produced is subject to diffraction.

It is an object of the invention to provide a guide system in which the modulation device functions according to an entirely different principle and is of very simple design.

SUMMARY OF THE INVENTION

In the guiding system according to the invention, the modulation device comprises a sight in the form of a band comprising repetitive motifs, a movement of translation at constant speed being created between the beam and the sight in a direction perpendicular to the axis of the beam, each motif comprising opaque and transparent parts, the opaque and/or transparent parts having a length (measured in the direction of displacement) which varies according to the height in question, and a time base is provided for determining the two coordinates of the missile.

The production of the modulation device in the form of a moving sight formed by repetitive motifs enables the sight, i.e. each motif, to be given a very simple design and the modulated beam obtained is consequently hardly subject to diffraction.

The sight is appropriately composed of a hollow drum rotated about its axis and a reflecting member is placed at the centre of the sight so as to reflect the beam, arriving along the axis of the sight, in a radial direction with respect to the sight.

In a simple embodiment, the opaque and transparent parts of the sight have sides inclined at 45° with respect to the edges of the sight and the opaque (or transparent) parts are particularly advantageously parallelograms, the two transparent (or opaque) parts adjacent such a parallelogram being triangles or trapeziums in head to tail arrangement.

In this embodiment of the sight, the mean rate of illumination is constant and equal to 50% whatever the position of the detector. This value is optimal as far as the link balance of the system is concerned.

The time base necessary for determining the coordinates of the detector from the signal emitted thereby is advantageously furnished by a second moving sight driven in synchronism with the modulation sight and decoupled therefrom for the detector.

BRIEF DESCRIPTION OF THE DRAWINGS

The invention will be more readily understood on reading the following description with reference to the accompanying drawings, in which:

FIG. 1 illustrates the principle of guiding a missile by light beams.

FIG. 2 schematically shows the emitter of the guiding system.

FIG. 3 shows the modulation devices of the emitter of FIG. 1.

FIGS. 4*a*, 4*b*, 4*c* show, in developped state, several embodiments of the modulation sight.

FIG. 5 shows the output signal from the detector of the missile obtained with the sight of FIG. 4*c*.

FIG. 6 illustrates the processing of said output signal with a view to determining the coordinates of the missile.

DETAILED DESCRIPTION OF PREFERRED EMBODIMENTS

Figure 7:
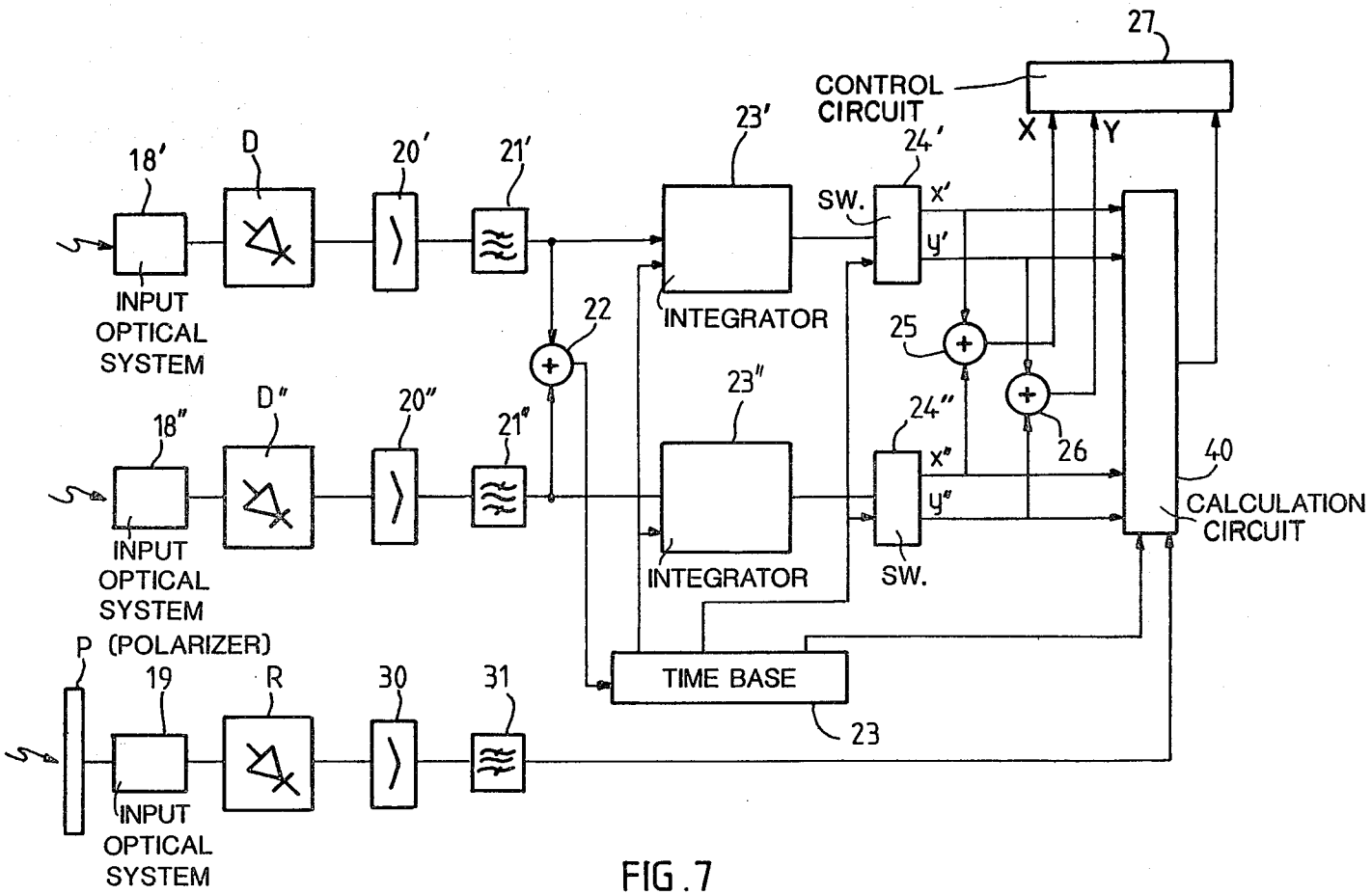
FIG. 7 is a diagram of the receiver placed on the missile.

Referring now to the drawings, FIG. 1 illustrates the principle of guiding a missile by modulated light beam. An emitter 1 coupled to the station firing the missile E emits a modulated light beam of which the axis is directed on the target C. The missile carries detectors D sensitive to the wave length of the beam emitted, and a processing circuit capable of determining the coordinates of the missle with respect to an absolute reference system linked to the axis of the beam, from the output signals from the detectors. The signals emitted by this processing circuit are applied to the control surfaces of the missile with a view to controlling its path on the axis of the beam.

FIG. 2 shows the general structure of the emitter 1, in an embodiment thereof. A laser source 2, preferably with continuous emission, operating for example at a wavelength of 10.6 $\mu$m produces a beam which is modulated by a modulation device 3 described in detail hereinafter. The block 4 represents the supply of the laser source 2 and block 5 the primary supply which comprises a battery.

The beam has rectilinear polarization, for a purpose which will be explained hereinafter.

The modulated beam transmitted by the optical system 6 is reflected by a mirror 7 onto a parabolic mirror 8 which acts as objective.

The optical system 6 comprises an afocal with variable magnification, or zoom, whose adjustment is controlled so that the section of the beam at missile level remains substantially constant, the purpose of this being to maintain the light power received by the detectors substantially constant. A circuit 9 having in memory the information "distance covered by the missile" appropriately controls the motor positioning the optical system 6.

The modulation device 3 will now be described in greater detail.

This device comprises a hollow cylindrical drum 10 of which the lateral surface presents parts transparent to the laser radiation and opaque parts, formed in a design obtained by repetition of a simple motif of which examples will be described hereinafter.

The drum 10 is rotated by a motor 11, and a regulation device of known type, comprising an opto-electronic source-pick up assembly 12 is provided to maintain the speed of the drum constant.

The drum 10 thus constitutes a moving sight which effects a modulation of the beam. The motor 11 also drives a drum 13 coaxial with respect to drum 10 and of which the lateral surface presents a design completely different from that of the drum 10 and which, as will be seen, enables a time base to be defined.

The laser beam issuing from the source 2 passes through the drum 13 radially and is reflected by a mirror 14, located at the centre of the drum, so that the axis of the reflected beam merges with the axis of the drums 13 and 10. The beam passes through a Wollaston prism 15 mounted in a hollow shaft driven by the motor 11 and impinges on a mirror 16 placed at the centre of the drum 10. The beam is thus reflected in a radial direction with respect to the rotating drum 10.

FIGS. 4*a*, 4*b* and 4*c* shows, in developed state, different embodiments of the modulation sight which correspond to different basic motifs. In all cases, the opaque and transparent sectors are defined by lines a inclined at 45° with respect to the edges b of the sight. In the case of FIG. 4*a*, the opaque and transparent sectors all have the form of right-angled isoscele triangles and, in the case of FIG. 4*b*, the sectors are constituted by isosceles trapeziums.

In these two embodiments, two consecutive lines of delimitation are always perpendicular.

In the embodiment of FIG. 4*c*, the two consecutive lines defining a transparent sector are, on the contrary, parallel, with the result that the transparent sectors are parallelograms and the opaque sectors are right-angled isoscele triangles, of which the arrangement is reversed each time. This embodiment presents the advantage over the preceding ones that the relative duration of illumination is equal to 50%, or the optimal value from the point of view of the link balance of the system, whatever the distance between the missile and the axis of the beam. This comes from the fact that the parallelograms always have the same dimensions parallel to their sides. Of course, it would be equivalent if the opaque sectors were constituted by parallelograms and the transparent sectors by triangles.

The principle of calculating the coordinates is as follows:

The left-hand side of FIG. 4*c* shows the field defined by the sight, the detector being at D. It will be noted that a system of axes has been chosen which is adapted to the design of the sight, i.e. axes Ox and Oy are parallel, respectively, to the sides a of the triangles constituting the opaque sectors.

In the following explanation, it will be assumed for greater clarity that the detector moves with respect to a beam passing through a fixed sight. It is in fact the opposite which happens, but the two cases are equivalent as far as functioning is concerned.

The horizontal passing through D is then the locus of the detector and the one passing through O is the locus of the trace of the axis of the beam.

The signal emitted by the detector is shown in FIG. 5, the rising edges corresponding to the passages from a non-illuminated zone to an illuminated zone and the falling edges to the reverse transitions.

Measurement of the time lapsing between two transitions furnishes a first relationship depending on the coordinates x and y, that is a function of $$\frac{y+x}{\sqrt{2}}.$$

To obtain a second relationship, the rate of illumination over a given period of reference T must be taken in consideration, T being a function of the shift due to the fact that D is not on the line $x+y=0$. It has been found that this shift is a function of $$\frac{y-x}{\sqrt{2}}$$

and, to this end, the processing circuit on the missile produces pulses baptised $+x, -y, +y, -x$ from the time base component furnished by the emitter, more particularly by the drum 13 in the present embodiment.

The signal of FIG. 5 is integrated over a period defined by two consecutive pulses. The signal of FIG. 6 is thus obtained, in which the coordinates x, y are given by the amplitudes upon each return to zero, the amplitudes successively furnishing $-x, +x, -y, +y$. As a matter of fact, the line $x=0$ coincides with the first raising sides of the isoscele triangles at the instants when the measure of x is started, plus T/2, said instants being that of the occurrence of the above mentioned x baptised pulses. In this case, the detector furnishes a signal of which the algebraic surface, obtained through integration, is zero. For a value of x, which is not zero, for instance k, the detector furnishes a signal of which the two positive and negative surfaces are proportional to $(1+k)$ and $(1-k)$, respectively. Thus, the algebraic surface of the signal, during the reference, or measuring period, is proportional to 2k, or k. This is the way to get x. The same reasoning is applicable to y, in considering the first falling sides of the isoscele triangles, to get y.

It will be seen that this is an extremely simple principle of calculation.

Concerning the time base, it has been seen that, in the present embodiment, a drum 13 was used, driven by the motor 11 as time base sight. If a speed of 50 r.p.s. is chosen as angular speed of the motor and if it is assumed that the developed sight comprises 10 triangles, disposed with their hypotenuse alternately on one edge of the sight then on the other, the frequency of the pulses, with two pulses per triangle, is $50\times10\times2=1000$ Hz.

To avoid the risks of interference or intermodulation between the different components of the composite signal received by the detector, the time base signal must be appropriately elaborated.

In this elaboration, the fact that the Wollaston prism 15, by its rotation associated with the movement of the time base sight, ensures a decoupling between the time base signal, if this signal is judiciously chosen, and the signal received by the detector resulting from the rotation of the drum 10, must be taken into account, so that the instants when the measure is started do not depend on the position of the image of the moving sight projected onto the detector. In other words, the moving sight should not support the time base, the instants of starting the measure having to occur when the line $x+y=0$ of the detector field passes by the tapering ends of the isoscele triangles of the moving sight, whatever the position of the detector in its field.

However, this double action—that of the drum 13 and that of the Wollaston prism 15—provokes on the time base component detected an effect of phase modulation at 100 Hz which increases with the moving away of the detector with respect to the axis of the beam and which, when the detector is in spaced apart relationship with respect to the axis, could lead to disturbing to some extent the sorting of the different data at reception.

Harmonic analysis shows that it is advantageous, for example, to constitute the time base component from two components, one at 450 Hz, the other at 550 Hz. The drum 13 is engraved correspondingly with more or less wide lines defining more or less transparent zones according to the amplitude of the time base component, as has been shows by way of example in FIG. 3 on part of the drum. The whole of the sight 13 is, of course, engraved in this manner.

However, the invention is not limited to this solution, and the time base may be obtained by any other appropriate means, particularly by modulating the beam with a high frequency which is modified either continuously or discontinuously, in determined manner.

The receiver present on the missile will now be described with reference to the diagram of FIG. 7.

The missile carries two detectors D', D'' disposed symmetrically with respect to its axis, and a third detector R associated with a polarizer P, for calculating the absolute roll. A suitable input optical system 18', 18'' and 19 is associated with each of the detectors.

An amplifier device 20', 20'', followed by an appropriate pass-band filter 21', 21'' is associated with each detector D', D''. The filtered signals are applied to an adder 22 of which the output is connected to the input of a time base elaboration circuit 23.

The circuit 23 extracts from the input signal the time base component produced by the drum 13 by an appropriate filtering in a band including 450 Hz and 550 Hz. The two 450 Hz and 550 Hz components are then isolated by new filterings and, from these components, the base frequency of 50 Hz corresponding to the speed of rotation of the sights is found.

The signals issuing from the filters 21', 21'', which are as shown in FIG. 5, are applied to integrators 23',23'', which furthermore receive a signal of frequency 1000 Hz from the time base circuit 23, this signal controlling the return to zero of the integrators.

The signals produced by the integrators 23', 23'' are illustrated in FIG. 6. It has been seen that these signals alternately furnish the coordinates $\pm x$ and $\pm y$ at the end of the periods of integration. A switching device 24', 24'' with one input channel and two output channels is therefore mounted at the output of each integrator, which switching device is controlled by a signal of frequency 250 Hz produced by the time base circuit 23. The coordinate x' (or x'') is thus obtained on one output channel and, on the other channel, the coordinate y' (or y'') of the detector D' (or D'').

The coordinates x' and x'' are added in an adder 25 which furnishes the mean $X=(x'+x'')/2$ and the adder 26 furnishes the mean $Y=(y'+Y'')/2$. These means correspond to the central coordinates of the missile, it being given that the detectors D' and D'' are placed symmetrically with respect to the axis of the missile.

The signals indicating these coordinates X and Y are applied to the circuit 27 for controlling the control surfaces of the missile. The circuit 27 acts on the control surfaces so as to bring the path of the missile closer to the ideal path defined by the axis of the beam, i.e. to cancel X and Y.

Furthermore, it is necessary, in the case of an auto-rotating missile, to know the absolute roll—i.e. the instantaneous angular position—of the missile to act on the control surfaces at the desired moment.

As has been mentioned, the device comprises a detector R with which is associated a polarizer. The beam emitted by the source 2 presents linear polarization and the Wollaston prism 15 rotates its plane of polarization at a speed of $2\times50=100$ r.p.s. The detection by the detector P would be effected with a frequency of $2\times100=200$ Hz if the missile were not in auto-rotation.

However, as the missile rotates on itself at a speed n (in r.p.s.), the frequency of detection is in fact $(200+2n)$ Hz.

An amplifier 30 and a pass band filter 31 adapted to the above frequency are associated with the detector P.

By comparing the signal thus obtained with a signal at the frequency of 200 Hz produced by the time base circuit 23 from the base frequency of 50 Hz, the absolute roll may be determined with high precision, but the value obtained is defined to within $\pi$ and this indetermination must be removed.

To this end, the coordinates x', y' and x'', y'' of the detectors D' and D'' are used. The coordinates x', x'', y', y'' are known only with average precision, but this precision suffices to remove the indetermination which affects the value calculated by the above method from the output signal of detector R.

These calculations are made in the circuit 40 for determining the absolute roll, which furnishes the value of the roll to the circuit controlling the control surfaces.

Figure 8:
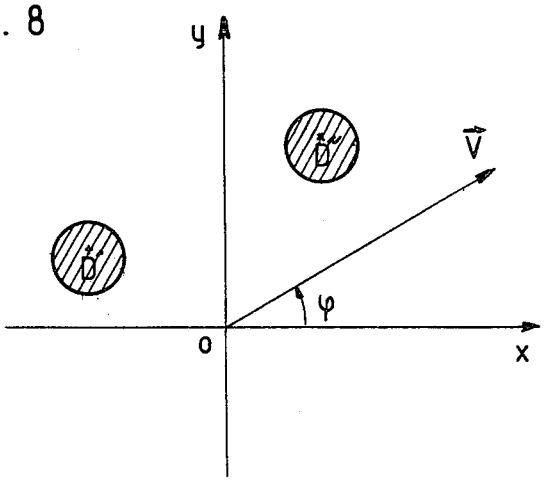
FIG. 8 illustrates the mode of determining the absolute roll in the receiver of FIG. 7.

The principle for determining the absolute roll is illustrated in FIG. 8.

The position of the detectors D' and D'' as may be determined on board the missile is vitiated by an imprecision illustrated by the circular hatched zones surrounding points D' and D''. The absolute roll $\phi$ is the angle made by the real vector $\overrightarrow{D'D''}$ with the origin vector $\overrightarrow{0x}$.

It has been seen above that this angle $\phi$ was obtained, from the output signal from the detector R, with a high precision, but to within $\pi$. If reference is made to FIG. 8, the vector $\vec{V}$ forming angle $\phi$ with $\overrightarrow{0x}$ and vector $-\vec{V}$ are obtained.

To remove this indetermination, the scalar product $\overrightarrow{D'D''}\cdot\vec{V}$ is calculated and the product calculated is arranged to be positive.

This principle assumes that the zones of incertitude of D' and D'' do not overlap. In practice, this condition is satisfied without difficulties.

Figure 9:
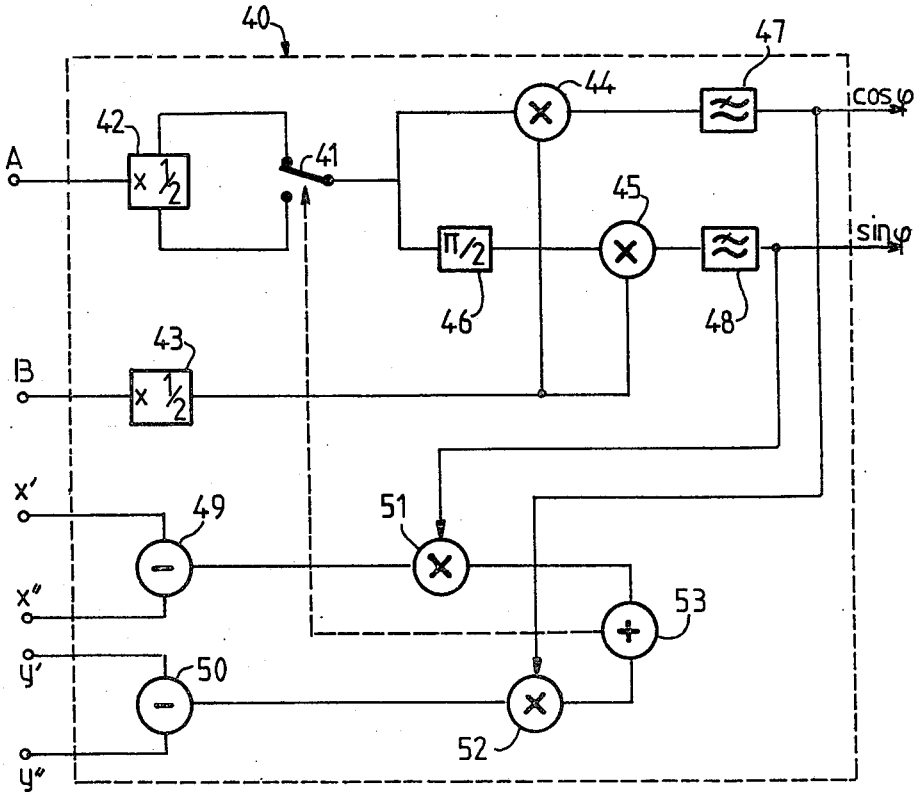
FIG. 9 shows the circuit for determining the absolute roll.

The scalar product $\overrightarrow{D'D''}\cdot\vec{V}$ is equal to $(x''-x')\cos\phi+(y''-y')\sin\phi$. The circuit 40 shown in FIG. 9 makes the calculation of this expression and comprises an inverter 41 which is employed to maintain this expression at a positive value.

The circuit 40 receives on input A the signal of frequency 200 Hz issuing from the time base circuit 23 and on input B the signal of frequency $(200+2n+2\phi)$ Hz issuing from the filter 31.

The signal arriving at terminal A is in the form $\cos 2\pi f_o t$ with $f_o=200$ Hz. It is applied to a circuit 42 dividing the frequency by 2, which furnishes the signals $\cos(\pi f_o t+k\pi)$ and $-\cos(\pi f_o t+k\pi)$, which are applied to the two inputs of the inverter 41 which, according to its position, transmits one or the other of these signals.

The signal arriving on terminal B is in the form cos $(2\pi f_R t+2\pi)$ with $f_R=(200+2n)$ Hz. This signal is applied to a circuit 43 dividing the frequency by 2, which delivers a signal cos $(\pi f_R t+\phi+k\pi)$.

This signal is applied to the multipliers 44 and 45. The multiplier 44 receives on the other hand the signal $\pm\cos(\pi f_o t+k\pi)$ issuing from the inverter and multiplier 45 receives the signal $\pm\sin(\pi f_o t+k\pi)$ obtained after phase shift of $\pi/2$ in a circuit 46 connected to the output of the inverter.

Low-pass filters 47 and 48 are respectively connected to the outputs of the multipliers 44 and 45, so that signals are obtained at the output of the filters 47 and 48, whose frequency is the difference of the frequencies of the input signals and which are thus indicative of the trigonometric functions cos $\phi$ and sin $\phi$ of the angle of absolute roll $\phi$.

On the other hand, the signals indicating the coordinates x',x'' and y',y'', issuing from the circuits 24' and 24'', are applied to subtractors 49 and 50 which deliver the differences $x''-x'$ and $y''-y'$. The outputs of the subtractors 49 and 50 are connected to multipliers 51 and 52 which receive the signals cos $\phi$ and sin $\phi$ of the filters 47 and 48. The products $(x''-x)\cos\phi$ and $(y''-y')\sin\phi$ are added in the circuit 53 which delivers the scalar product $D'D''\cdot V$ mentioned hereinabove.

The output signal from the adder 53 is applied as control signal to the inverter 41 (link shown in dotted lines) so that the latter is always in the position which leads to a positive scalar product. The values cos $\phi$ and sin $\phi$ obtained at the outputs C and D are applied, as has been indicated, to the circuit for controlling the control surfaces.

We claim:

1. In a system for guiding a missile in a direction of sight, comprising, at emission, a source of emission producing a light beam of which the axis defines the direction of sight and a device for modulating the beam emitted, and on the missile, at least one photo-detector and a processing circuit for determining, from the output signal from the detector, at least one coordinate of the missile with respect to the direction of sight, said coordinate being applied to the control surfaces of the missile in order to control the path of the missile on the direction of sight, characterized in that the modulation device comprises a sight in the form of a band comprising repetitive motifs, a movement of translation at constant speed being created between the beam and the sight, in a direction perpendicular to the axis of the beam, each motif comprising opaque and transparent parts, the opaque and/or transparent parts having a length (measured in the direction of displacement) which varies according to the height in question, and a time base is provided for determining the two coordinates of the missile, wherein the sight is a hollow drum rotated about its axis and a reflecting member is placed at the centre of the sight so as to reflect the beam arriving along the axis of the sight, in a radial direction with respect to the sight.

2. The system of one of claim 1, wherein the opaque and transparent parts of the sight have sides inclined at 45° with respect to the edges of the sight.

3. The system of claim 2, wherein the opaque (or transparent) parts are parallelograms, the two transparent (or opaque) parts adjacent such a parallelogram being triangles or trapeziums in head to tail arrangement.

4. The system of claim 1, wherein the time base necessary for determining the coordinates of the detector from the signal emitted thereby is furnished by a second moving sight driven in synchronism with the modulation sight and decoupled therefrom for the detector.

5. The system of claim 4, wherein the second sight is a drum coaxial with respect to the modulation sight at the centre of which is placed a reflecting member, which reflects the beam issuing from the source and having passed radially through the second sight towards the reflecting member placed at the centre of the modulation sight.

6. The system of one of claims 1, 4 or 5, wherein the beam has a linear polarization, means are provided at emission to rotate the beam and therefore its plane of polarization, and the missile carries two photo-detectors placed symmetrically with respect to the axis of the missile, a third photo-detector, associated with a polarizer and a calculating circuit furnishing the absolute roll $\phi$ of the missile from the output signal from the third photo-detector and the coordinates (x',y') (x'',y'') furnished by the processing circuits associated with the first two photo-detectors.

7. The sytem of claim 6, wherein the calculating circuit comprises means for forming the difference between the frequency of the output signal from the third photo-detector and the one corresponding to the speed of rotation of the plane of polarization, said means furnishing the angle of roll $\phi$ to within $\pi$, said means including an inverter which may take two positions, corresponding to the two possible values for $\phi$, and means for calculating the expression $(x''-x')\cos\phi+(y''-y')\sin\phi$, the inverter being controlled so that this expression is constantly positive.

* * * * *